United States Patent [19]

Donner

[11] 4,137,850

[45] Feb. 6, 1979

[54] DESTRUCT INITIATION UNIT

[75] Inventor: Egon F. Donner, Los Gatos, Calif.

[73] Assignee: The United States of America as represented by the Secretary of the Navy, Washington, D.C.

[21] Appl. No.: 840,937

[22] Filed: Oct. 11, 1977

[51] Int. Cl.[2] ..... F42C 11/00

[52] U.S. Cl. ..... 102/215

[58] Field of Search ..... 102/215, 218–220, 102/263

[56] References Cited

U.S. PATENT DOCUMENTS

| | | | |
|---|---|---|---|
| 2,628,458 | 12/1971 | Sands | 102/215 |
| 3,153,520 | 10/1964 | Morris | 102/215 |
| 3,470,419 | 9/1969 | Sitler et al. | 102/263 |
| 3,531,691 | 9/1970 | Sitler et al. | 102/263 |
| 3,560,863 | 2/1971 | Baumoel | 102/215 |
| 3,570,404 | 3/1971 | Pope | 102/215 |
| 3,646,371 | 2/1972 | Flad | 102/215 |
| 3,914,732 | 10/1975 | Brumleve et al. | 102/215 |

*Primary Examiner*—Charles T. Jordan

*Attorney, Agent, or Firm*—R. S. Sciascia; Charles D. B. Curry; Francis I. Gray

[57] ABSTRACT

A destruct initiation unit having a high current source connected to a detonator by a gap switch which is triggered by either a commanded destruct signal or an auto-destruct signal. A CMOS input logic circuitry provides noise immunity and pulse-width discrimination, and the destruct output from the input logic circuitry is delayed before triggering the gap switch to provide sufficient time to monitor the status of the destruct initiation unit for failure analysis.

17 Claims, 6 Drawing Figures

$PW \geqslant \Delta t - (t_2 - t_1)$

DESTRUCT INITIATION UNIT

BACKGROUND OF THE INVENTION

1. Field of the Invention

The present invention relates to destruct initiation circuits, and more particularly to a destruct initiation circuit which includes a high current source connected to a detonator by a gap switch.

2. Description of the Prior Art

Prior destruct initiation circuits which used gap switches, such as that disclosed in U.S. Pat. No. 3,628,458 by Emmett J. Sands, provided a single circuit for both auto-destruct and command destruct signals. These circuits had several problems which could cause premature triggering of the gap switch, or could cause no triggering of the gap switch. For example, the use of one SCR for the auto-destruct signal and a second SCR for the command destruct signal to switch a high current pulse through a trigger transformer to trigger the gap switch results in multiple triggers being applied to the gap switch, the so-called "rapid fire" problem, due to voltage gradients in the circuit. Also, failure of a diode in the high voltage bridge rectifier circuit causes a high voltage ac signal to be impressed across the energy-storage capacitor resulting in failure due to overheating of the capacitor or premature firing of the gap switch due to the abnormally high voltage peaks. Additionally, prior circuits were susceptible to noise induced signals triggering the gap switch.

Another problem was the inability to isolate faults in the system since the telemetry signal was either saturated by the high current output pulse, or the almost instantaneous response of the circuit resulted in no telemetry data of the circuit status.

SUMMARY OF THE INVENTION

Accordingly, the present invention provides a destruct initiation unit having a high current source connected to a detonator by a gap switch. A diode in the current source between the bridge rectifier and the energy-storage capacitor isolates the capacitor from high voltage ac signals due to bridge rectifier failure. A CMOS input logic circuit isolates the logic input control lines and provides noise immunity and pulse-width discrimination for the control lines. The auto-destruct and command destruct control signals and delayed by a timer to provide sufficient telemetry data for failure analysis. The output of the timer gates "on" an SCR. A duplicate auto-destruct/command destruct signal turns on a high current solid state amplifier which in conjunction with the SCR provides a high current pulse to a trigger transformer which provides a single trigger to the gap switch to provide a destruct output to the detonator.

The high current source has an EMI shield surrounding it with all signals being input and output via feedthrough capacitors to prevent telemetry saturation. Additionally, high voltage ionization is eliminated by using an external mounting flange so there are no holes in the EMI shield to cause depressurization.

Therefore, it is an object of the present invention to provide a destruct initiation unit of greater safety.

Another object of the present invention is to provide a destruct initiation unit immune from premature triggering.

A further object of the present invention is to provide a destruct initiation unit having fault isolation capability.

Still other objects, advantages and novel features of the present invention will be apparent from the following detailed description when read in view of the claims and attached drawing.

DESCRIPTION OF THE PREFERRED EMBODIMENT

Figure 1:
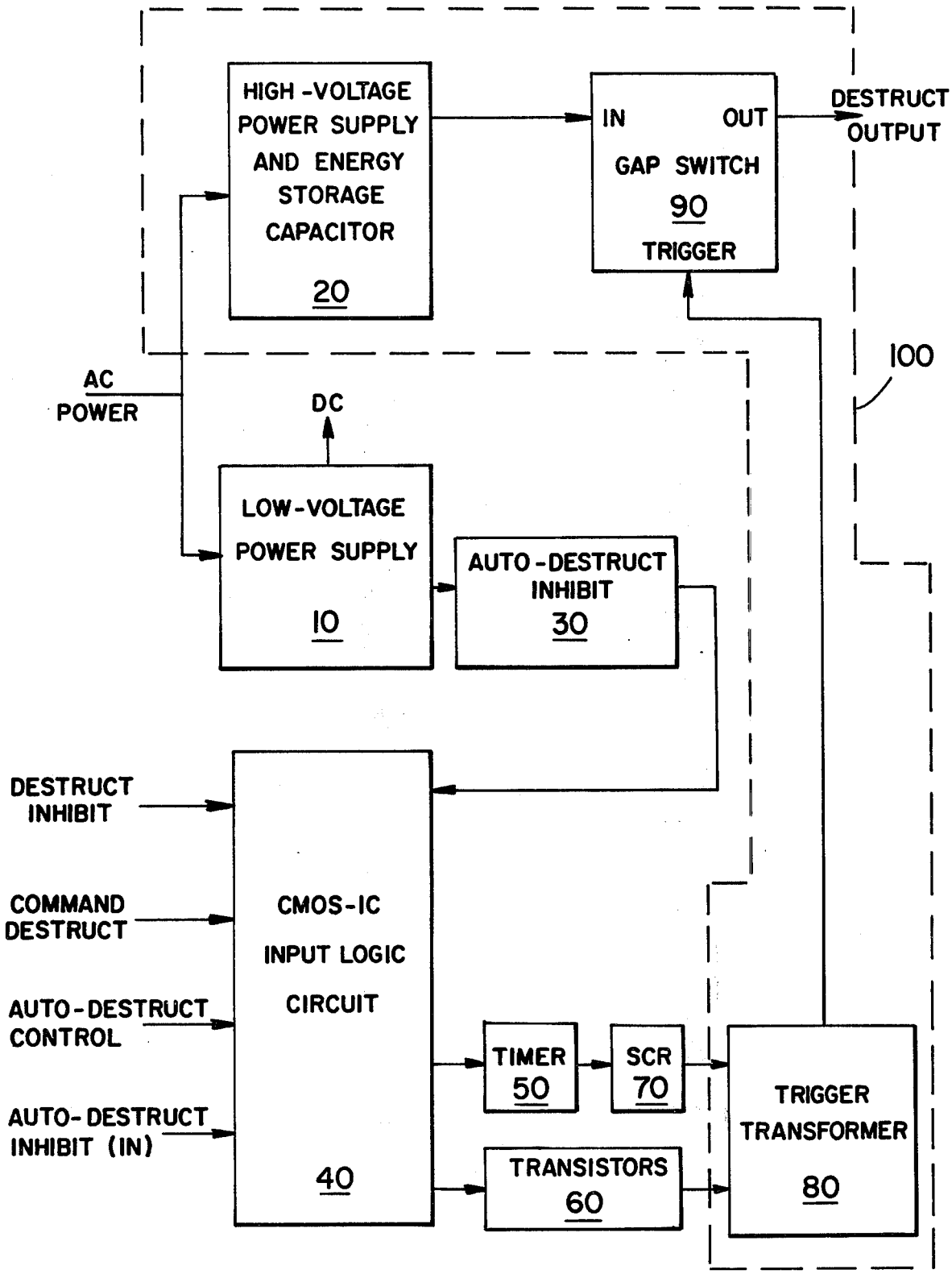
FIG. 1 is a block diagram of a destruct initiation unit according to the present invention.

Referring now to FIG. 1 ac power is applied to a low voltage power supply 10 and a high voltage power supply 20. The low voltage power supply 10 provides a dc source for various electronic circuits and a signal to an auto-destruct inhibit circuit 30. The output of the auto-destruct inhibit circuit 30 is input along with external signals into an input logic circuit 40. The external signals include destruct inhibit, command destruct, auto-destruct control and auto-destruct inhibit (In). The input logic circuit 40 provides redundant destruct signals to a timer 50, which delays the signal for a predetermined period, and the high current gain transistors 60. After the timer 50 times out the delayed destruct signal triggers a silicon-controlled rectifier (SCR) 70 which completes the circuit with the transistors 60 to provide a high current pulse to a trigger transformer 80. The output of the high voltage power supply 20 is stored in a capacitor and applied as a very high dc voltage to the input of a triggered gap switch 90. The current pulse through the trigger transformer 80 is applied to the gap switch 90 to produce a destruct output of high energy to set off a detonator which in turn destroys the pressure integrity of an aerospace vehicle propulsion stage in a safe and predictable manner. The command destruct signal is a ground command under the control of the Range Safety Officer, and the auto-destruct signal is a vehicle generated command in response to an identified malfunction.

Figure 2:
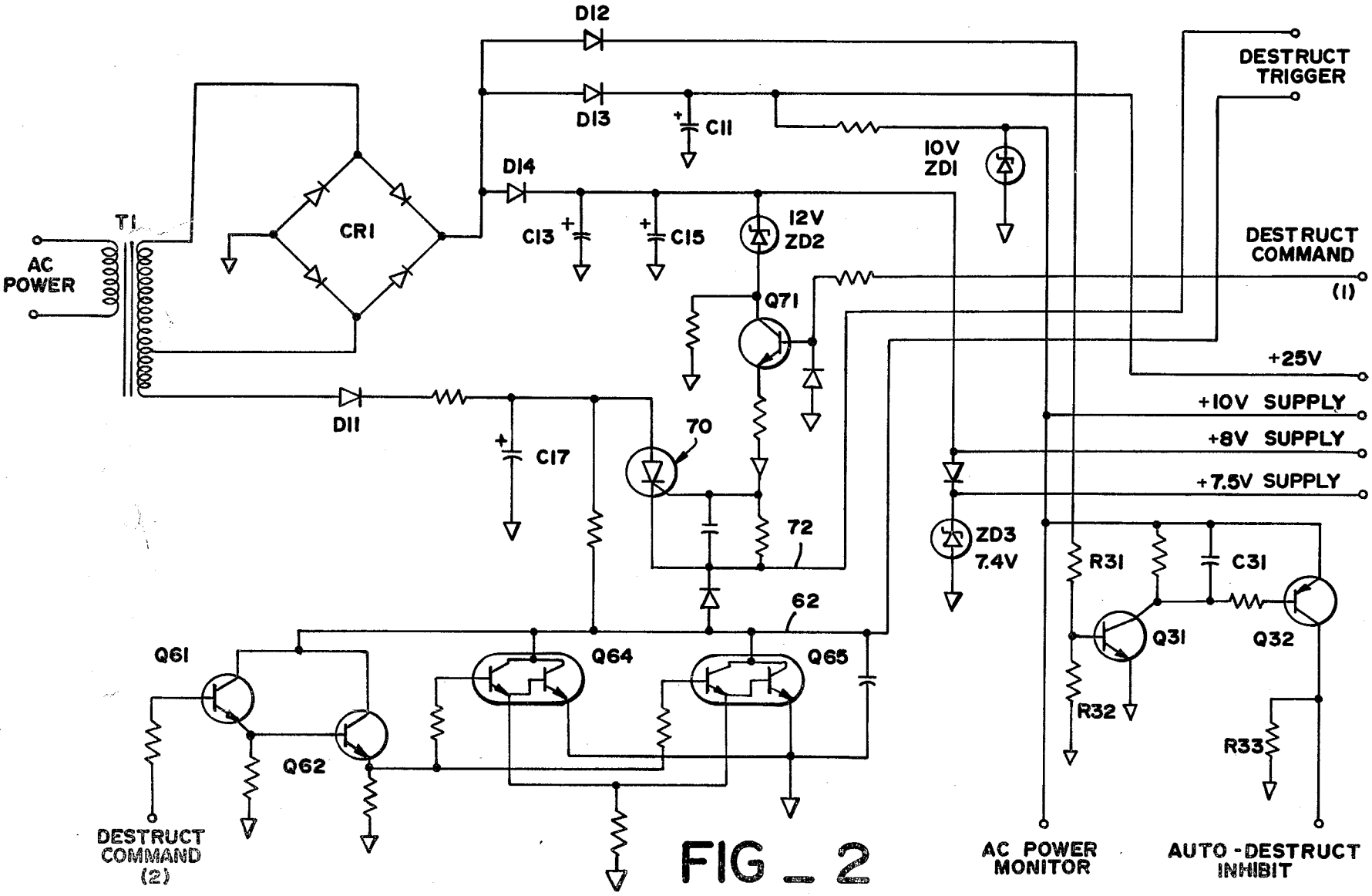
FIG. 2 is a schematic diagram of the low voltage power supply, the high current transistor, the auto-destruct inhibit and the SCR circuits for the destruct initiation unit.

The low voltage power supply 10, shown in greater detail in FIG. 2, transforms the ac power via transformer T1 to an appropriate voltage level which is applied to a full wave bridge rectifier CR1 and a half-wave rectifier D11. Diodes D12, D13, D14 are used for each output line from the bridge rectifier CR1 to generate a dc level with varying storage requirements. Zener diodes ZD1, ZD2 and ZD3 provide voltage regulation for each supply line, with standard RC filters being used to smooth the rectified ac from the bridge rectifier CR1. An ac power monitor connected to one output dc line provides a digital monitor of the power status since there would be no dc voltage unless the ac power was present.

The auto-destruct inhibit circuit 30 of transistors Q31, Q32 and associated circuitry. A dc voltage from the bridge rectifier CR1 is applied to a voltage divider R31, R32 to bias "on" transistor Q31 when ac input power is present. With Q31 "on" transistor Q32 is also biased "on" and applies the supply voltage (10 volts) directly to the auto-destruct inhibit output across output resistor R33.

A destruct command signal, which has been delayed, is applied to the base of transistor Q71 to turn it "on" and apply a high voltage to the gate of SCR 70 to cause the SCR to conduct. Conduction of SCR 70 places a relative high voltage to line 72 which is applied to one side of the trigger transformer 80. A second destruct command is applied to the base of transistor Q61 in cascade with transistor Q62 to turn "on" the parallel high current Darlington transistor Q64, Q65, which effectively places a relative ground on line 62 which is applied to the other side of the trigger transformer 80, resulting in a high current pulse.

Figure 3:
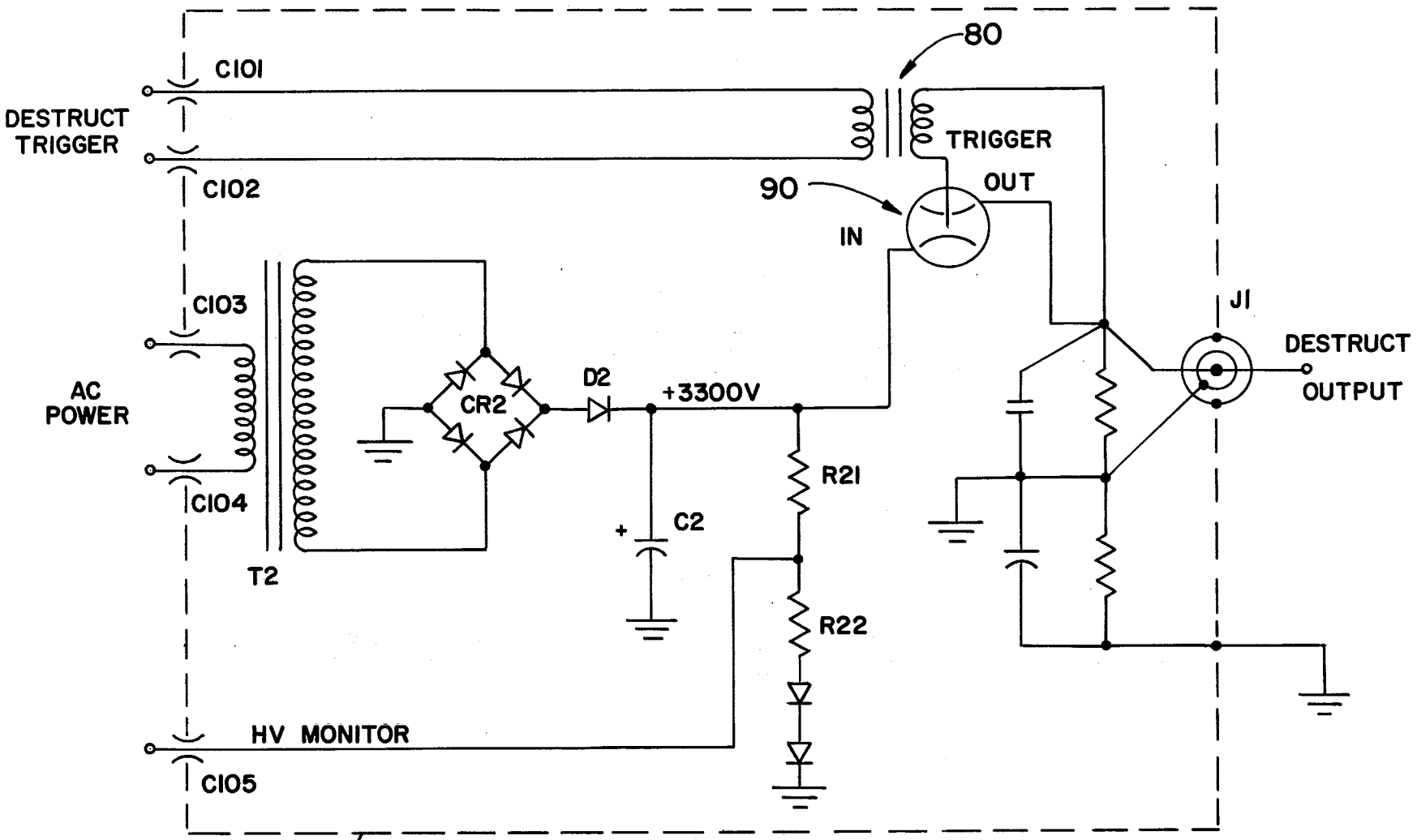
FIG. 3 is a schematic diagram of the high voltage power supply, gap switch and trigger transformer circuits for the destruct initiation unit.

The high voltage supply 20, shown in greater detail at FIG. 3, is similar to the low voltage supply 10 in that ac power is transformed to a suitable voltage which is rectified by a full wave bridge rectifier CR2 with a diode D2 in the output of the bridge rectifier to block any ac feedthrough in the event of a failure of one of the bridge diodes. The ac feedthrough due to bridge diode failure could result in capacitor C2 failure due to heating by the high circulating ac current, thus removing the high voltage at the input of the gap switch 90 (no function), or could result in breakdown of the gap switch at the ac peaks, thus providing spurious destruct outputs (multiple firings). Energy is stored in high voltage capacitor C2, charged to a high voltage of the order of 3300 volts, so that should there be an ac power interrupt there would still be sufficient power to trigger the destruct ordnance for a limited time after the interrupt. A voltage divider network of resistors R21, R22 provides a high voltage monitor signal proportional to the high voltage input to the gap switch 90 as well as a discharge path for capacitor C2.

The destruct trigger pulse from SCR 70 and transistor circuit 60 is applied to the trigger of gap switch 90 through the trigger transformer 80. With the gap switch 90 enabled by the high voltage from the high voltage supply 20, a high voltage destruct output from the gap switch is applied through jack J1 to the detonation ordnance. The entire high voltage circuitry, including power supply 20, trigger transformer 80 and gap switch 90 is enclosed within an electromagnetic interference (EMI) shield 100 with all input and output signals routed through feedthrough capacitors C101, C102, C103, C104, C105. The EMI shield 100 also provides pressure integrity to eliminate ionization problems.

Figure 4:
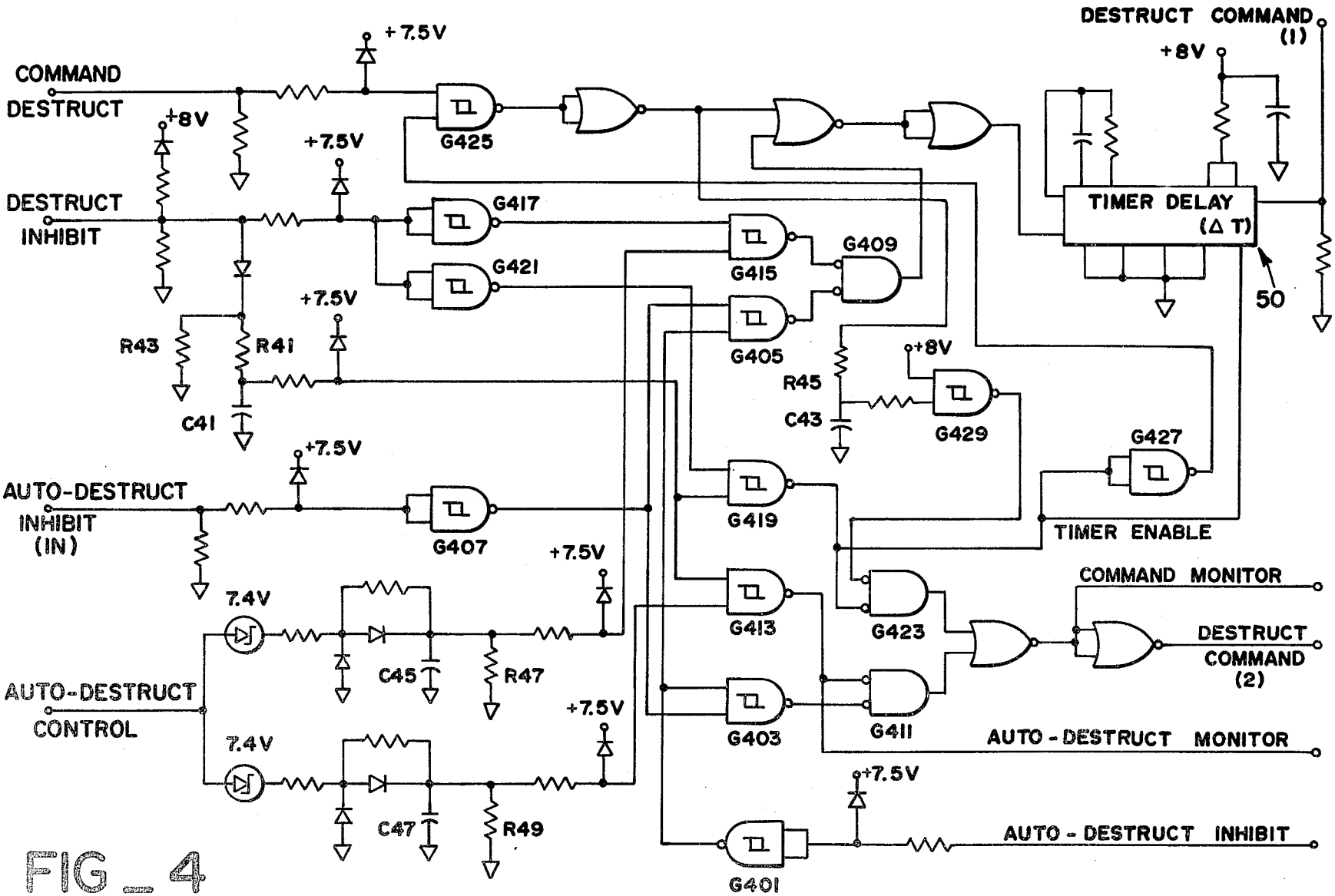
FIG. 4 is a schematic diagram of the input logic circuit and the timer for the destruct initiation unit.

The input signals to the input logic circuit 40 are a command destruct signal transmitted to the vehicle by FR from the ground to terminate vehicle flight, a destruct inhibit signal which prevents spurious signals on the input lines from triggering the destruct ordnance, an input auto-destruct inhibit which prevents auto-destruct while the vehicle is within the immediate launch area for personnel safety, and an auto-destruct control signal generated when a specific vehicle malfunction is determined internally to automatically destroy the vehicle. As shown in greater detail in FIG. 4, the input logic circuit 40 uses CMOS integrated circuit input gates which provide significant noise immunization by providing a high threshold approximately equal to one-half the power supply voltage. Photodiodes or other photooptic devices may also be used to provide input noise immunization.

The auto-destruct inhibit signal from the auto-destruct inhibit circuit 30 is input through CMOS gate G401 to CMOS gates G403, G405 to which are also input the input auto-destruct inhibit signal through CMOS gate G407. Only when the auto-destruct inhibit signal is absent will CMOS gates G403, G405 enable AND gates G409, G411 to allow an auto-destruct control signal to provide a destruct command output. The auto-destruct control signal is applied to CMOS gates G413, G415. The destruct inhibit signal through CMOS gate G417 holds CMOS gate G415 disabled until the signal is removed, and also charges capacitor C41 through resistor R41 having a relatively short charge time constant which enables CMOS gate G413 to pass the auto-destruct control signal to AND gate G411. When the destruct inhibit signal is removed, CMOS gate G415 is enabled to pass the auto-destruct control signal to AND gate G409. Capacitor C41 discharges through resistor R43 having a relatively long discharge time constant to hold CMOS gate G413 enabled for a period after removal of the destruct inhibit signal, a period which is longer than the delay period of the timer 50.

The output of AND gate G409 is input to the timer 50, which may be a monostable multivibrator, a delay line or the like, the output of which is the destruct command signal to trigger SCR 70. The output of AND gate G411 is the second destruct command signal applied to the transistor circuit 60. The timer delay is of sufficient duration to allow at least two frames of telemetry data to be transmitted so the status of the auto-destruct monitor from CMOS gate G413, the command monitor, the high voltage monitor and the ac power monitor may be recorded to determine the source of the destruct trigger pulse for post-flight fault analysis.

The destruct inhibit signal is also applied to CMOS gate G419 via CMOS gate G421 together with the delayed destruct inhibit signal from capacitor C41. When the destruct inhibit signal is removed, AND gate G423 is enable, as is CMOS gate G425 and the timer 50 via CMOS gate G427. The command destruct signal passes through CMOS gate G425 and is applied to the input of timer 50 to provide the destruct command signal to SCR 70. The command destruct from CMOS gate G425 is also applied via CMOS gate G429 to AND gate G423 to provide the second destruct command signal to the transistor circuit 60.

If the command destruct signal is too short, the second destruct command to the transistors 60 will no longer be present when SCR 70 is triggered by the delayed destruct command. The result is no trigger pulse to the trigger transformer 80 with no resulting destruct detonator. Thus, the input logic circuit 40 also provides a pulse width discrimination test for the destruct command input signal.

During launch the auto-destruct capability of the destruct initiation unit is disabled by the input auto-destruct inhibit signal until the vehicle is sufficiently clear of the launch area so as not to present a safety hazard to ground personnel and the launch facility. Generally this signal is derived from the accelerometer data as integrated to provide a range gate. After launch the destruct initiation unit is armed by application of ac power to the low voltage and high voltage power supplies 10, 20 which also provides an auto-destruct inhibit signal from the auto-destruct inhibit circuit 30.

Should it be determined from the ground that it is necessary or desirable to terminate the vehicle flight, a command destruct signal is sent to the vehicle. The destruct inhibit signal is removed when a valid auto-destruct control signal or command destruct signal is generated. The destruct signal is verified for amplitude and pulse width to eliminate spurious commands due to noise and is applied to the trigger transformer 80 via the SCR 70 and transistor circuit 60 to provide a single high current pulse to trigger the gap switch 90 which applies high voltage to the destruct detonator.

Figure 5A:
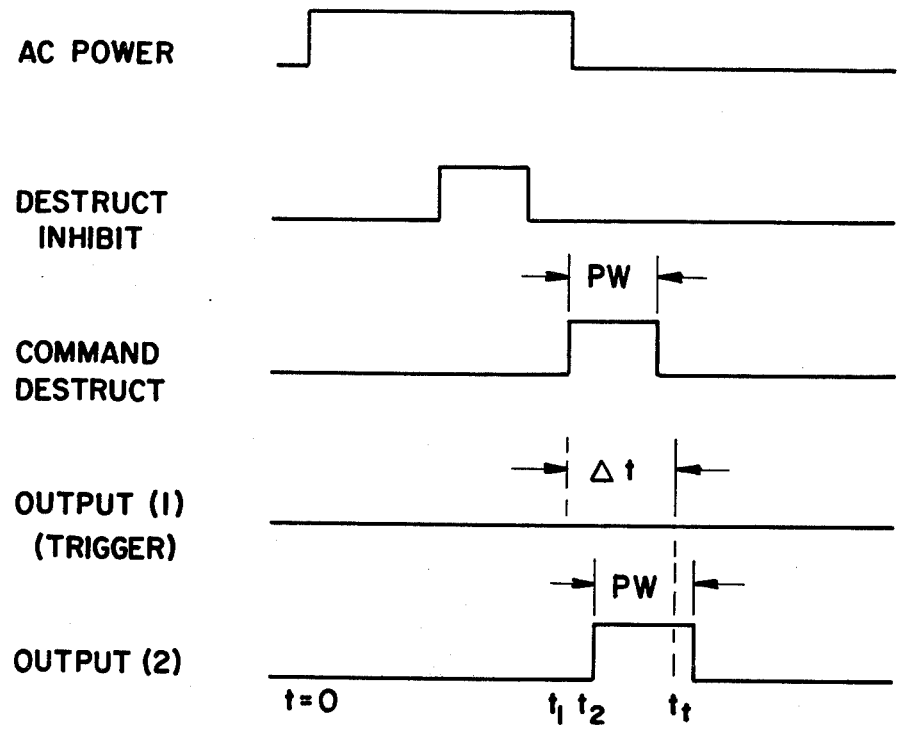
FIG. 5 is a timing diagram (*a*) for a command destruct event and (*b*) for an auto-destruct event.

Referring now to FIG. 5*a* for a command destruct sequence the ac power provides the energy which is stored in the low voltage power supply capacitors C11, C13, C15, C17 to provide dc power for a period after the ac power is removed. Also, the high voltage capacitor C2 is also charged. A destruct inhibit pulse of sufficient width to fully charge capacitor C41 occurs. After the destruct inhibit pulse terminates, a command destruct signal having a pulse width, PW, greater than a specified minimum value is received. Timer 50 converts the leading edge of the command destruct signal at time $t_1$ into the SCR destruct command pulse delayed by a time $\Delta t$. The command destruct signal is also delayed slightly at the input to CMOS gate G429 by capacitor C43 before providing the second destruct command signal with the leading edge at time $t_2$. Since the SCR destruct command and the second destruct command are required to occur at the bases of transistors Q71 and Q61 simultaneously to provide the destruct trigger pulse, the pulse width of the command destruct signal is given by the equation:

$$PW \geqq \Delta t - (t_2 - t_1). \quad (1)$$

Figure 5B:
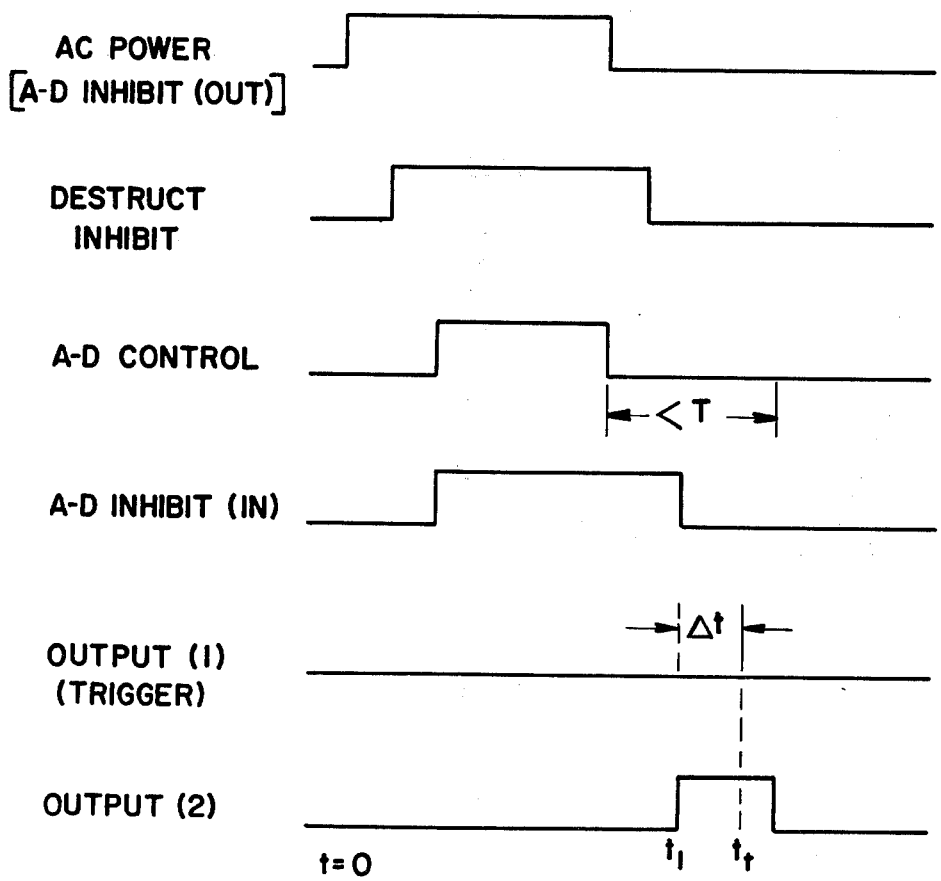

For the auto-destruct sequence shown in FIG. 5*b* the auto-destruct control signal charges capacitors C45, C47 which have a long discharge time constant through resistors R47, R49, respectively, on the order of seconds as opposed to milliseconds for timer delay $\Delta t$, for example. After the ac power signal ends CMOS gates G405, G403 are enabled so that when both the auto-destruct inhibit (In) signal and the destruct inhibit signal terminate within time T after the auto-destruct control signal terminates gate G409 provides an output signal at time $t_1$ to the timer 50 to provide the SCR destruct command at $t_1+\Delta t$. The second destruct command occurs when the auto-destruct inhibit (In) signal terminates. Termination of the second destruct command occurs when either C47 or C41 discharge below the threshold of CMOS gate G413.

For a normal separation event the auto-destruct control signal goes to a negative value to discharge capacitors C45, C47 rapidly in a matter of milliseconds to prevent an erroneous destruct trigger during normal vehicle staging.

Thus, the present invention provides a destruct initiation unit with improved noise rejection capabilities which provides a single trigger pulse to the gap switch, thereby lengthening the gap switch life and reliability. Telemetry failure analysis is also enhanced by delaying the destruct command until the status monitors have been sampled and by effectively shielding the high voltage sections to eliminate high voltage noise from swamping the telemetry data.

What is claimed is:

1. An improved destruct initiation unit having a high voltage potential source connected to a detonator by a gap switch which initiates said detonator upon receiving a destruct signal, the improvement comprising:

(a) means for delaying execution of said destruct signal to allow for determination of the source of said destruct signal before said detonator is initiated; and (b) means for immunizing said destruct initiation unit from noise to prevent a false destruct signal from initiating said detonator.

2. An improved destruct initiation unit as recited in claim 1 further comprising means for obtaining a single trigger pulse from said destruct signal to prevent rapid fire of said gap switch.

3. An improved destruct initiation unit as recited in claim 2 further comprising means for blocking an ac power signal in the output of said high voltage potential source when there is a malfunction of said high voltage potential source to prevent failure of said destruct initiation unit due to said malfunction.

4. An improved destruct initiation unit as recited in claim 3 further comprising means for shielding said high voltage potential source and said gap switch to prevent saturation of monitoring circuits which allow for determination of the source of said destruct signal, and further providing pressure integrity for said high voltage potential source and said gap switch to prevent ionization when said destruct initiation unit is operating in a reduced pressure environment.

5. An improved destruct initiation unit as recited in claim 4 wherein said obtaining means comprises a single silicon-controlled rectifier (SCR) triggered by said destruct signal.

6. An improved destruct initiation unit as recited in claim 5 wherein said blocking means comprises a diode connected in the output of said high voltage potential source to prevent said ac power signal from appearing across a output storage capacitor.

7. An improved destruct initiation unit as recited in claim 6 wherein said shielding means comprising an electrically conductive case completely enclosing said high voltage potential source and said gap switch, said case being electrically connected to an external ground plane, having feedthrough capacitors to provide for passage of electrical signals through said case, and being capable of maintaining an internal pressure.

8. An improved destruct initiation unit as recited in claim 7 wherein said delaying means comprises a monostable multivibrator circuit which is triggered by said destruct signal to provide an output destruct signal to said obtaining means after a predetermined time delay.

9. An improved destruct initiation unit as recited in claim 8 wherein said immunizing means comprises:

(a) a CMOS input gate for said destruct signal, said gate having a high noise threshold limit; and (b) means for minimum pulse width determination of said destruct signal to prevent a false narrow pulse width signal from initiating said detonator.

10. An improved destruct initiation unit as recited in claim 9 wherein said minimum pulse width determination means comprises:

(a) an RC delay network to delay said destruct signal; and (b) means for comparing said destruct signal with said delayed destruct signal to provide a destruct signal trigger to said delaying means.

11. An improved destruct initiation unit as recited in claim 8 wherein said immunizing means comprises:

(a) a photooptic input device for said destruct signal, said device having a high noise threshold limit; and (b) means for minimum pulse width determination of said destruct signal to prevent a false narrow pulse width signal from initiating said detonator.

12. An improved destruct initiation unit as recited in claim 11 wherein said minimum pulse width determination means comprises:

(a) an RC delay network to delay said destruct signal; and (b) means for comparing said destruct signal with said delayed destruct signal to provide a destruct signal trigger to said delaying means.

13. An improved destruct initiation unit as recited in claim 7 wherein said delaying means comprises a delay line which delays said destruct signal to provide an output destruct signal to said obtaining means after a predetermined time delay.

14. An improved destruct initiation unit as recited in claim 13 wherein said immunizing means comprises:

(a) a CMOS input gate for said destruct signal, said gate having a high noise threshold limit; and (b) means for minimum pulse width determination of said destruct signal to prevent a false narrow pulse width signal from initiating said detonator.

15. An improved destruct initiation unit as recited in claim 14 wherein said minimum pulse width determination means comprises:

(a) an RC delay network to delay said destruct signal; and (b) means for comparing said destruct signal to provide a destruct signal trigger to said delaying means.

16. An improved destruct initiation unit as recited in claim 13 wherein said immunizing means comprises:

(a) a photooptic input device for said destruct signal, said device having a high noise threshold limit; and (b) means for minimum pulse width determination of said destruct signal to prevent a false narrow pulse width signal from initiating said detonator.

17. An improved destruct initiation unit as recited in claim 16 wherein said minimum pulse width determination means comprises:

(a) an RC delay network to delay said destruct signal; and (b) means for comparing said destruct signal with said delayed destruct signal to provide a destruct signal trigger to said delaying means.

* * * * *